United States Patent [19]

Gephart et al.

[11] Patent Number: 4,811,683

[45] Date of Patent: Mar. 14, 1989

[54] SLIDING DOOR WHEEL RETAINER

[75] Inventors: John D. Gephart, La Verne; Torsti T. T. Jerila, West Covina, both of Calif.

[73] Assignee: Acme General Corporation, San Dimas, Calif.

[21] Appl. No.: 8,822

[22] Filed: Jan. 30, 1987

[51] Int. Cl.[4] ..... E05D 13/02

[52] U.S. Cl. ..... 16/97; 16/100; 49/425

[58] Field of Search ..... 16/97, 98, 100, 102, 16/106, 107, 90; 49/425

[56] References Cited

U.S. PATENT DOCUMENTS

| | | | |
|---|---|---|---|
| 809,696 | 1/1906 | Keil | 16/97 |
| 938,493 | 11/1909 | Kurtzon | 16/100 |
| 1,934,299 | 11/1933 | Fairhurst | 49/425 X |
| 3,033,285 | 5/1962 | Banner | 49/425 |
| 3,683,451 | 8/1972 | Tanner | 16/90 |
| 3,956,854 | 5/1976 | Yamamoto | 16/100 X |
| 4,633,615 | 1/1987 | Moose | 16/100 X |

FOREIGN PATENT DOCUMENTS

| | | | |
|---|---|---|---|
| 1104543 | 2/1968 | United Kingdom | 49/425 |

OTHER PUBLICATIONS

Brochure "Coulage les Nouvelles Techniques de Coulissis", by Krieg-Zivy Company, France, date unknown.

*Primary Examiner*—Nicholas P. Godici
*Assistant Examiner*—Carmine Cuda
*Attorney, Agent, or Firm*—Christie, Parker & Hale

[57] ABSTRACT

A wheel retainer prevents a wheel of a sliding or bypass door from jumping off of the floor track on which the wheel rolls. Portions are provided on the lower portion of the retainer for slidably engaging a downwardly facing portion of the track for inhibiting upward movement of the retainer from the track. Preferably this in the form of an L-shaped hook having a base wider than the opening of a dovetail slot in the track and a neck narrower than the opening of the slot. The retainer can then be installed only by pivoting the retainer relative to the track for inserting the hook. The retainer also has portions for engaging an upper portion of the wheel to prevent it from being lifted from the track. The preferred embodiment is a D-shape with an arcuate portion over the top of the wheel and barbs that prevent the retainer from accidentally being dislodged from the wheel.

26 Claims, 3 Drawing Sheets

SLIDING DOOR WHEEL RETAINER

BACKGROUND OF THE INVENTION

This invention concerns a retainer to keep the wheels on a bypass door from jumping off the track.

Bypass doors are now employed for many openings, such as closets. Such doors are sometimes referred to as sliding doors, even though they typically roll on wheels. In a typical opening, two or more doors are mounted on wheels that roll in parallel tracks. The tops of the doors are guided in parallel tracks. When the doors are closed, one door is against the right jamb, and the other door is against the left jamb. The doors can be opened from either edge since they roll in separate tracks. Although two doors is most common in an opening, one, three or more doors may be used.

Two principal types of wheels and tracks are used for bypass doors. Some tracks have a slot and the wheels have a central flange that fits into the slot. Such a wheel rolls on the surfaces on each side of the flange, which engage the two top surfaces of the track on opposite sides of the slot. Another type of track has a raised rib and a wheel for such a track has two flanges that straddle the track. Such a wheel rolls on the top of the rib on a surface between the two flanges. Such a rib may have parallel sides, a circular bead at the top, or have an arrow shaped cross section on which the wheel rolls. Tracks are commonly extruded aluminum or roll formed sheet steel.

A problem that sometimes occurs with such bypass doors is jumping of the wheels from the supporting track. This may occur if the door is pushed violently, which may dislodge it from the track. This is most likely to occur when the door slams hard against the jamb. This is at least an inconvenience since it is then necessary to place the door back on the track to operate satisfactorily.

Unfortunately, this can also be hazardous if the door drops far enough upon leaving track that the top guides no longer engage the upper track. This can permit the door to topple, with possible injury to anyone nearby. This is a particular problem in installations where the track is near the edge of a ledge, such as when the floor of a closet is elevated relative to the floor of the adjacent room. If the wheels should jump off the track in such an installation, the door can drop off the ledge and may then topple.

It is, therefore, desirable to provide some means for assuring that the door does not jump off the track. One type of anti-jump attachment for a door has been proposed. This attachment is used with a track having an arrowhead shape. The attachment has a U-shaped opening with a pair of barbed spring fingers that snap over the arrowhead. This attachment is permanently a part of the mounting bracket for the wheel.

It is common to provide a vertical adjustment for the wheels on a bypass door. This is provided since the height of openings is not uniform and it may be desirable to raise or lower a door to better fit the opening. It also occurs that the door jambs may not be plumb. In that event, it is desirable to raise or lower the wheels selectively to tilt the door slightly to have its edge parallel to the jamb against which the door closes.

If an attachment that prevents jumping of the door from the track is secured to the door, the ability to vertically adjust the door may be inhibited. It is, therefore, desirable to provide means for preventing a wheel from jumping the track, which is vertically adjustable with the wheel. It is also desirable to provide such a means that can be installed after the doors are in place. This gives the option of omitting the anti-jump device if desired, and may make door installation and adjustment easier. It is also desirable that the anti-jump device positively retain the door on the track, instead of just increasing the force that causes the wheels to jump from the track.

SUMMARY OF THE INVENTION

There is, therefore, provided in practice of this invention according to a presently preferred embodiment, a wheel retainer that comprises means for slidably engaging a downwardly facing portion of a floor track for inhibiting upward movement of the retainer from the track, and means for engaging an upper portion of the door supporting wheel, thereby securing the wheel to the track.

In a preferred embodiment the wheel retainer has a generally D-shaped body with an arcuate member fittable over the top of the wheel, and generally L-shaped hooks at the bottom, which can be removed from a slotted dovetail track only by pivoting the body relative to the track. Barbs fit over the top of the flange on a wheel to inhibit removal of the retainer.

BRIEF DESCRIPTION OF THE DRAWINGS

These and other features and advantages of the present invention will be appreciated as the same becomes better understood by reference to the following detailed description and accompanying drawings, wherein.

DETAILED DESCRIPTION

Figure 1:
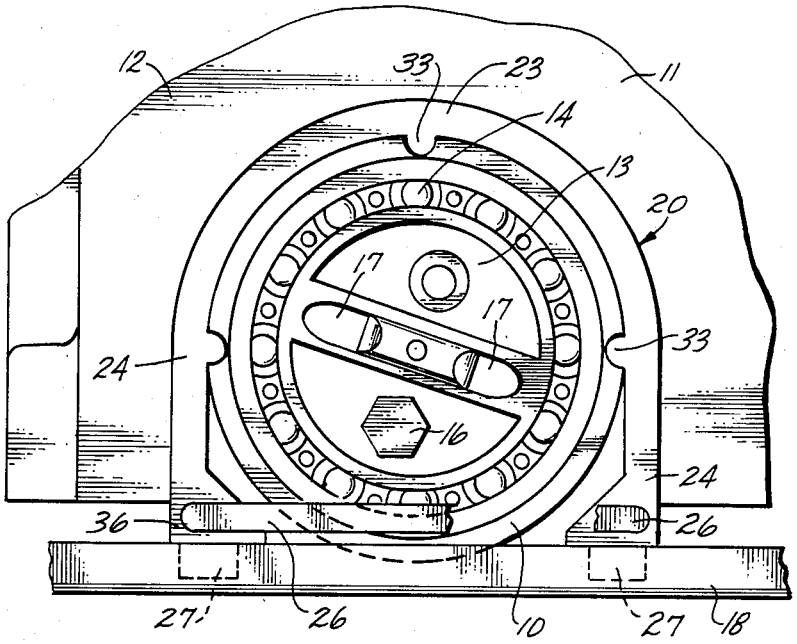
FIG. 1 illustrates in side view a wheel retainer constructed according to principles of this invention installed on a wheel on a door.
Figure 2:
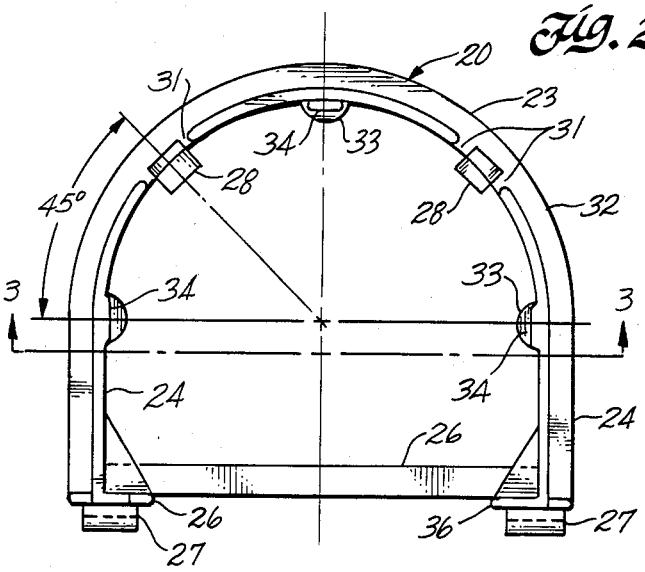
FIG. 2 is a side view of the wheel retainer from the opposite side from the view of FIG. 1.
Figure 3:
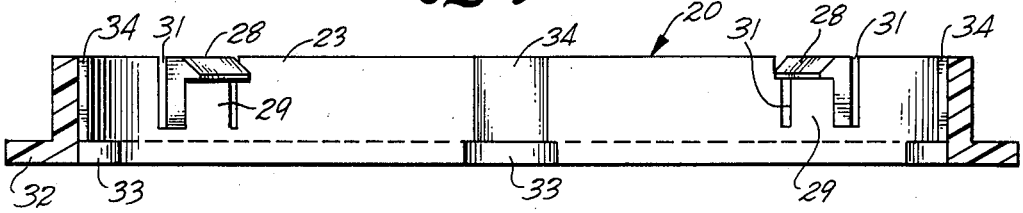
FIG. 3 is a horizontal cross section of the retainer at line 3—3 in FIG. 2.

In an exemplary embodiment a wheel 10 is mounted on a door panel 11 by a conventional corner connecter 12. The wheel is mounted on a hub 13 by a conventional ball bearing 14. The hub is secured to the corner connecter by a bolt 16. The bolt is eccentric with respect to the axis of rotation of the wheel. This permits easy adjustment of the height of the wheel relative to the door, i.e., adjustment of the door relative to the track to fit the frame. To make such an adjustment the bolt is loosened, and a screwdriver or similar instrument inserted in an opening 17 is used to pivot the hub around the axis of the bolt. The bolt is tightened when the proper door height is achieved.

Figure 4:
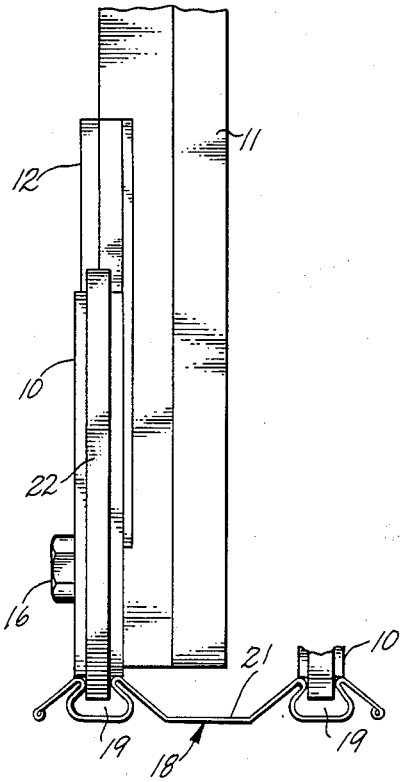
FIG. 4 is a view of a wheel mounted on a door, as viewed from the jamb edge of the door.

As seen in FIG. 4, the track 18 for the doors has a pair of dovetailed slots 19 extending along the length of the track. That is, each of the slots has a relatively narrower opening at the top and a wider internal space below the top. The track is secured to the floor by screws (not shown) in the web 21 between the slots. Such a track is readily roll formed from prepainted sheet steel. Each of the wheels 10 has a central flange 22 which fits into the respective slot in the track.

The wheel retainer is a generally D-shaped body 20 having an arcuate top portion 23, the inside surface of which has a radius of curvature only slightly larger than the radius of the flange on the wheel. Thus the arcuate portion of the retainer fits closely around the upper portion of the wheel. The arcuate portion 23 is substantially semi-circular, and blends into tangentially extending legs 24, which extend down to the track. A horizontal crossbar 26 interconnects the two legs to keep them a fixed distance apart.

The wheel retainer is preferably molded of a slightly flexible elastic material such as nylon. The wheels for a bypass door are typically made of an acetal resin and nylon is a particularly good material for contacting acetal polymers since there is a low coefficient of friction and very little noise. Nylon is also desirable for engaging the painted steel track because of its low coefficient of friction and freedom from undesirable noise. Other plastic materials such as polypropylene or the like may also be used.

Figure 5:
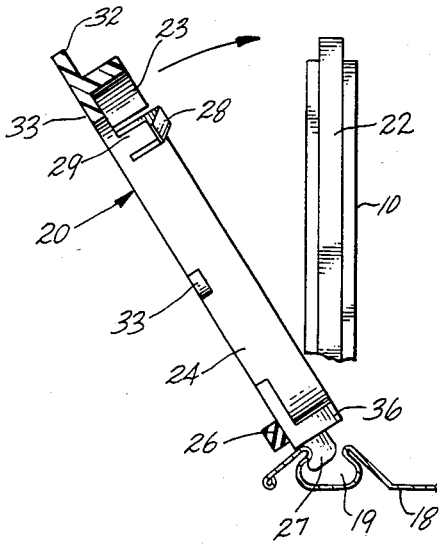
FIG. 5 is an end view of a track, a wheel, and a cross section of a retainer being installed on the wheel.

At the bottom of each of the legs 24, there is a generally L-shaped hook 27 extending downwardly and then away from the wheel face of the retainer. The horizontal base of the hook is longer than the width of the opening of the slot in the track (see FIG. 5). Thus, the hook cannot move in or out of the track in the vertical direction. The neck of the hook between the base and the foot at the bottom of each leg has a thickness less than the opening of the slot in the track. To install the wheel retainer, it is tilted away from the plane of the wheel. The tips of the hooks are placed in the slot in the track. The retainer is then pivoted toward the vertical position. The L-shaped hook is rounded internally and externally, so as to fit smoothly into (or out of) the slot in the track when so pivoted.

When the retainer is pivoted to its vertical position, the arcuate top portion of the retainer fits over the upper portion of the flange on the wheel. A pair of barbs 28 are formed on slightly flexible fingers 29 defined by slots 31 in the arcuate portion of the retainer. When the barbs encounter the flange of the wheel as the retainer is being installed, they are elastically deflected and snap over the flange to keep the retainer from being dislodged from the wheel. A peripheral stiffening rim 32 on the retainer can be gripped to pull the retainer off of the wheel in the event it is desired to remove it. Nylon provides sufficient flexibility in the retainer that it can be snapped off of the wheel without undue force.

Three tabs 33 are formed on the arcuate portion of the retainer to engage the exposed face of the wheel. Thus, when installed, the retainer is maintained in a vertical position between the tabs 33 on one face of the wheel and the barbs 28 on the opposite face of the flange.

In the illustrated embodiment slightly raised pads 34 are formed on the inside of the arcuate portion of the retainer. These tabs slidably engage the perimeter of the flange on the wheel. The relative dimensions of the retainer and wheel are such that these pads raise the retainer and largely prevent the feet 36 at the bottoms of the legs of the retainer from rubbing against the upper surface of the track. Rubbing between the retainer and track is therefore limited to the downwardly facing surfaces inside of the dovetailed slot. Thus, there can be no scarring of the painted steel track by the retainer. Due to accumulation of tolerances in manufacturing operations, the dimensions may not prevent a little tilting of the retainer as the door is rolled and the bottom of one of the legs may contact the top of the track. The pads are not an essential feature and clearance may be left between the perimeter of the flange and the retainer so that there is an opportunity for the retainer to contact the exposed surface of the track. When nylon or the like is employed to form the retainer, this does not appear to be a problem.

Tests were made of a door having two wheels, each fitted with wheel retainers as provided in practice of this invention. In this test a door was mounted plumb in a frame where the jamb was one half inch out of plumb over the height of the door. The door was a standard mirror door two feet wide and six feet, eight inches tall. A cable connected to the edge of the door extended through the jamb and over a pulley so that weights could be added to the cable.

In the test the door was held 12 inches from the jamb, and weights were added to the cable. The door was then released to be accelerated toward the jamb by the weights. When the door slammed into the jamb, it was simply noted whether one or more of the wheels jumped off of the track. Ten such slams were performed at each weight level.

When the weight was up to six pounds the wheels were not dislodged from the track, regardless of whether wheel retainers were used. At a little over six pounds one out of ten slams resulted in the door jumping off of the track when no wheel retainers were used. At about six and one half pounds pull weight, five out of ten trials without wheel retainers resulted in the door jumping out of the track. When the pulling weight was as little as eight pounds, ten out of ten trials without a wheel retainer resulted in the door jumping off the track.

This is to be contrasted with tests where wheel retainers were used. In those tests, the door never jumped off the track, even when the pull weight reached 32 pounds. This magnitude of slamming began to tear the steel frame of the door, instead of dislodging the door from the track. Even at smaller pull weights, lifting of the track between screws and elastic deformation of the nylon retainer could be readily observed when the door slammed. Thus, under extreme conditions, such a wheel retainer effectively prevented dangerous jumping of the wheels from the floor track.

Figure 6:
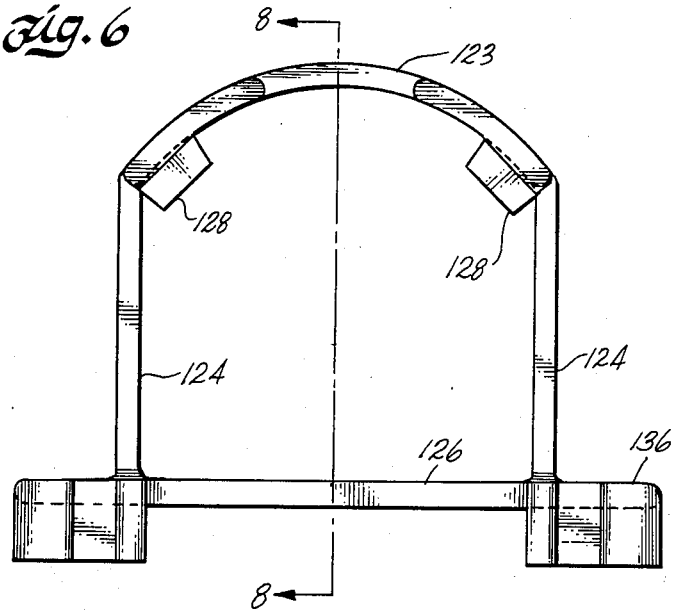
FIG. 6 is a side view of a second embodiment of wheel retainer constructed according to principles of this invention.
Figure 7:
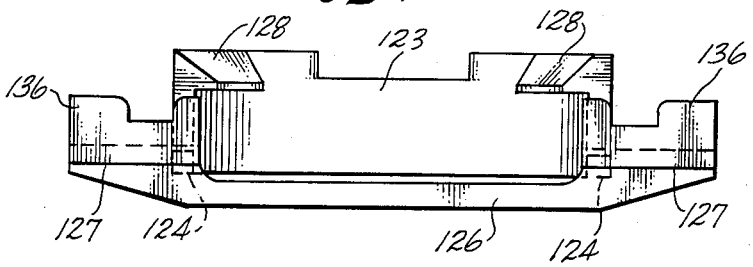
FIG. 7 is a bottom view of the wheel retainer of FIG. 6.
Figure 8:
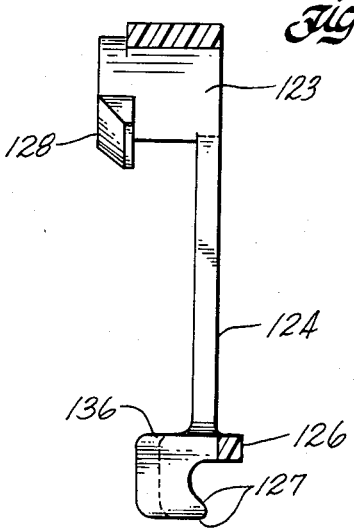
FIG. 8 is a transverse cross section of the wheel retainer along line 8—8 in FIG. 6.

FIGS. 6 to 8 illustrate another embodiment of wheel retainer constructed according to principles of this invention. Many of the parts of this retainer are analogous to the corresponding parts in the embodiment hereinabove described and illustrated, and to that extent the parts in this embodiment are identified with reference numerals one hundred larger than the corresponding reference numerals in FIGS. 1 to 5. For example, this embodiment of the wheel retainer has an arcuate top 123 analogous to the arcuate top 23 in the first embodiment.

Generally speaking this embodiment of wheel retainer is for use with a smaller diameter wheel than the above described embodiment and where the space available surrounding the wheel is relatively confined.

This is an advantage of this embodiment, without limiting the places where it might be used.

The arcuate top 123 of the wheel retainer connects to a pair of slender vertical legs 124. The legs extend down to the track (not shown) and are interconnected at the bottom by a horizontal cross bar 126. The radius of curvature of the inside surface of the arcuate top on the wheel retainer is larger than the radius of the flange on a typical wheel with which the retainer is used. In this embodiment the legs 124 are long enough that the feet 136 at the bottoms of the two legs rest on the top surface of the track and there is clearance between the flange of the wheel and the arcuate portion of the retainer body. In the event the wheel lifts slightly from the track, however, it will engage the arcuate portion and be retained so as not to be dislodged from the track.

Also, the legs are closer together than the outside diameter of the wheel flange so that as the wheel retainer is installed in the same general manner as hereinabove described, the legs fit into the space between the outer diameter of the flange and the outer diameter of the portion of the wheel that rides on the track. The retainer contacts the corner connector (not shown) and generally speaking, the legs do not engage the wheel. Alternatively, the legs can engage the side of the flange on the wheel, somewhat in the manner of tabs 33 in the first embodiment.

At the bottom of each of the legs 124 there is a generally L-shaped hook 127 extending downwardly and then away from the wheel face of the retainer. The horizontal base of the hook is longer than the width of the opening in the slot of the track so that the hook cannot move in or out of the track in the vertical direction. The narrower neck between the base of the L-shaped hook and the enlarged foot 136 at the base of the leg has a width that is narrower than the opening of the slot in the track so that the hook can freely slide within the slot in the track as the door is moved.

As in the previous embodiment, to install the wheel retainer it is tilted away from the plane of the wheel. The tips of the hooks are placed in the slot of the track, the retainer is then pivoted toward the vertical position. When it is in its vertical position, the arcuate top portion of the retainer fits over the upper portion of the flange on the wheel. A pair of barbs 128 extend generally radially inwardly from each end of the arcuate portion 123.

This arcuate portion has a relatively thicker cross section than the slender legs 124 and hence has greater stiffness. When the arcuate portion is pushed toward the wheel during installation, the barbs encounter the flange of the wheel and bending of the legs permits the barbs to snap over the flange of the wheel to keep the retainer from being dislodged. The upper arcuate portion can be pulled from the wheel or pried with a screwdriver to reverse the elastic deformation of the legs and disengage the bars from the rim of the wheel. By molding the part from nylon and providing slender legs, sufficient flexibility is provided to enable easy installation and removal.

Since this embodiment may be preferable for a small diameter wheel, the feet 136 on which the hooks are formed extend laterally from the body of the wheel a greater distance than the space between the legs. This provides a greater span between the hooks and tends to minimize chatter as the wheel retainer is moved along the track.

Although but two embodiments of wheel retainer have been described and illustrated in detail, it will be apparent to one skilled in the art that many modifications and variations are possible. For example, instead of the center of the D-shaped retainer being open, a membrane may be formed across the face of the retainer, thereby effectively concealing the wheel. Such an embodiment prevents access to the hub for height adjustment of the eccentrically mounted wheel when the retainer is in place. It can, of course, be removed for adjustment. Such a "closed" wheel retainer may also be used with doors where the wheels are not adjustable or where a screw adjustment or the like is used on the corner connecter.

The L-shaped hook which prevents vertical removal of the hook from the slot and requires pivoting of the retainer relative to the track for installation or removal, prevents removal of the wheel from the slot in the track. If desired, an elastic means may be used for engaging the track to merely inhibit jumping. This may be in the form of a split spear that elastically deforms to fit into the slot in the track. It will be recognized that a split spear can be made to prevent removal of a wheel from the track by inserting a shim into the split between the two legs of the spear. Alternatively, in an embodiment where the track has a bead along the top of a rail, a pair of fingers may elastically snap over the bead to inhibit the removal of the retainer from the track. A hook in a dovetail track as hereinabove described is preferred since it positively prevents removal of the wheel from the track and it is easily installed by pivoting.

The preferred embodiment of wheel retainer provided in practice of this invention is D-shaped for stiffness. Other shapes may be employed for interconnecting means on the lower portion of the retainer which engage a downwardly facing portion of the track, and means on the upper portion for engaging the upper portion of the wheel. For example, a rectangular or X-shaped or possibly even a Y-shaped member on the face of the wheel can provide such an interconnection. Such a configuration does not provide as much stiffness as the D-shaped form fitting over the perimeter of the wheel. Addition of ribs on the face to stiffen such a configuration may undesirably increase the effective thickness of the wheel and retainer. Such embodiments may require more material in the molded part, and hence may not be as economical as the embodiments illustrated.

Some bypass doors are hung from overhead tracks. In such an embodiment, wheels at the top of the door roll in a suspending track. Guides may be provided at the bottom to keep the doors from swinging. A retainer as provided in practice of this invention may be modified for retaining the supporting wheels in an overhead track.

It will also be recognized that a retainer which prevents wheels from being withdrawn from the track can be used where security is desired. Burglars have long known that locked sliding doors can often be lifted from the track to provide unauthorized entry. This invention provides an easily installed retainer which prevents such lifting of the door. Many other uses and modifications of this invention will be apparent to those skilled in the art.

What is claimed is:

1. A wheel retainer for a sliding door having a door panel, a floor track and a wheel for rolling along the track and supporting the door panel, the retainer comprising:

a body;

means on the lower portion of the body for engaging a downwardly facing portion of the track for inhibiting upward movement of the retainer from the track; and means on the upper portion of the body for engaging an upper portion of the perimeter of the wheel for inhibiting upward movement of the wheel.

2. A wheel retainer as recited in claim 1 comprising means on the upper portion of the body for engaging a portion of the wheel for inhibiting removal of the body from the wheel.

3. A wheel retainer for a sliding door having a door panel, a floor track and a wheel for rolling along the track and supporting the door panel, the retainer comprising:

a body;

means on the lower portion of the body for engaging a downwardly facing portion of the track for inhibiting upward movement of the retainer from the track; and at least one barb on an elastically flexible finger on an upper portion of the body for snapping over an upper portion of a flange on the wheel and inhibiting removal of the body from the wheel.

4. A wheel retainer as recited in claim 1 wherein the track comprises a dovetail slot for receiving the wheel, and the means for engaging the track fits into the dovetail slot and has a portion wider than the opening of the slot.

5. A wheel retainer as recited in claim 4 wherein the means for engaging the track comprises a generally L-shaped hook having a base longer than the width of the opening of the slot which prevents vertical removal of the hook from the slot and a neck narrower than the width of the opening of the slot.

6. A wheel retainer as recited in claim 1 wherein the means for engaging the track can be removed from the track only by pivoting the body relative to the track.

7. A wheel retainer as recited in claim 6 wherein the means for engaging the track comprises a generally L-shaped hook having a base which prevents vertical removal of the hook from the track.

8. A wheel retainer as recited in claim 1 wherein the body comprises an arcuate portion fittable over the top of the wheel for inhibiting removal of the body from the wheel.

9. A wheel retainer for a sliding door having a door panel, a floor track and a wheel for rolling along the track and supporting the door panel, the retainer comprising:

a body having an arcuate portion fittable over the top of the wheel for inhibiting removal of the body from the wheel;

means on the lower portion of the body for engaging a downwardly facing portion of the track for inhibiting upward movement of the retainer from the track;

means on the upper portion of the body for engaging an upper portion of the wheel;

at least one barb on an elastically flexible finger for snapping over a flange on the wheel and inhibiting removal of the retainer from the wheel; and wherein the track comprises a dovetail slot for receiving the wheel; and the means for engaging the track comprises a generally L-shaped hook having a base longer than the width of the opening of the slot which prevents vertical removal of the hook from the slot.

10. A wheel retainer for a sliding door having a door panel, a floor track and a wheel for strolling along the track and supporting the door panel, the retainer comprising:

a body;

means on the lower portion of the body for engaging a downwardly facing portion of the track for inhibiting upward movement of the retainer from the track; and at least one barb on the upper portion of the body for engaging a portion of the wheel for inhibiting removal of the body from the wheel, and wherein the body is sufficiently flexible to bend for snapping the barb over a flange on the wheel.

11. A wheel retainer for a sliding door having a door panel, a floor track having a dovetail slot, and a wheel having a flange fittable into the slot for rolling along the track and supporting the door panel, the retainer comprising:

a generally D-shaped body having a straight member parallel to the track and an arcuate member fittable over the top of the wheel;

means adjacent the straight member for fitting into the slot and inhibiting vertical movement of the body from the track; and means on the arcuate portion for engaging the flange and inhibiting removal of the body from over the top of the wheel.

12. A wheel retainer as recited in claim 11 wherein the means fittable into the dovetail slot has a portion wider than the opening of the slot.

13. A wheel retainer as recited in claim 12 wherein the means fittable into the dovetail slot comprises a generally L-shaped hook having a base longer than the width of the opening of the slot which prevents vertical removal of the hook from the slot.

14. A wheel retainer as recited in claim 11 wherein the means fittable into the slot can be removed from the track only by pivoting the body relative to the track.

15. A wheel retainer as recited in claim 11 wherein the means for engaging the flange comprises a barb on the arcuate portion fittable over the top of the flange.

16. A wheel retainer as recited in claim 11 comprising vertically extending legs tangent to the arcuate portion and extending downwardly to the straight member.

17. A wheel retainer as recited in claim 16 wherein the legs are sufficiently flexible to bend for engaging the removal inhibiting means and the flange.

18. A wheel retainer for a sliding door having a door panel, a floor track having a dovetail slot, and a wheel having a flange fittable into the slot for rolling along the track and supporting the door panel, the retainer comprising:

a generally D-shaped body having a straight member parallel to the track, an arcuate member fittable over the top of the wheel and a pair of legs interconnecting the ends of the arcuate portion and the straight member;

at least one barb on the arcuate portion for snapping over a flange on the wheel and inhibiting removal of the retainer from the wheel;

a generally L-shaped hook at the end of each leg adjacent to the straight member and extending away from the leg, each hook having a base longer than the width of the opening of the slot which prevents vertical removal of the hook from the slot, the hook being positioned so that it can be removed from the track only by pivoting the body relative to the track.

19. A wheel retainer as recited in claim 18 wherein the relative dimensions of the wheel and body are such that the arcuate portion slidably engages the top of the wheel.

20. A wheel retainer as recited in claim 18 wherein the barb is on an elastically flexible finger for snapping the barb over a flange on the wheel.

21. A wheel retainer as recited in claim 18 wherein the legs are sufficiently flexible for bending for snapping the barb over a flange on the wheel.

22. A wheel retainer for a sliding door having a door panel, a floor track having a dovetail slot, and a wheel for rolling along the track and supporting the door panel, the retainer comprising:

a body having a portion that fits over an upper portion of the wheel for engaging the perimeter of the wheel for inhibiting upward movement of the wheel; and at least one L-shaped hook at the bottom of the body having a base longer than the width of the opening of the slot and a neck between the base and the body narrower than the width of the opening of the slot.

23. A wheel retainer as recited in claim 22 comprising means on the upper portion of the body for engaging a portion of the wheel for inhibiting removal of the body from the wheel.

24. A wheel retainer for a sliding door having a door panel, a floor track having a dovetail slot, and a wheel for rolling along the track and supporting the door panel, the retainer comprising:

a body having a portion that fits over the top of the wheel;

at least one L-shaped hook at the bottom of the body having a base longer than the width of the opening of the slot and a neck between the base and the body narrower than the width of the opening of the slot; and at least one barb on the upper portion of the body for engaging a portion of the wheel for inhibiting removal of the body from the wheel, and wherein the body is sufficiently flexible to bend for snapping the barb over a flange on the wheel.

25. A wheel retainer for a sliding door having a door panel, a floor track having a dovetail slot, and a wheel for rolling along the track and supporting the door panel, the retainer comprising:

a body having a portion that fits over the top of the wheel;

at least one L-shaped hook at the bottom of the body having a base longer than the width of the opening of the slot and a neck between the base and the body narrower than the width of the opening of the slot; and at least one barb on an elastically flexible finger on the upper portion of the body for snapping over a flange on the wheel and inhibiting removal of the retainer from the wheel.

26. A wheel retainer for a sliding door having a door panel, a floor track having a dovetail slot, and a wheel having a flange fittable into the slot for rolling along the track and supporting the door panel, the retainer comprising:

a body having a lower portion adjacent to the track and an upper portion adjacent to an upper portion of the wheel;

means adjacent to the lower portion for fitting into the slot and inhibiting vertical movement of the body from the track;

means on the upper portion for engaging the wheel perimeter for inhibiting upward movement of the wheel; and means on the upper portion for engaging the wheel flange and inhibiting removal of the body from over the top of the wheel.

* * * * *